US005406817A

United States Patent [19]

Takakura et al.

[11] Patent Number: 5,406,817

[45] Date of Patent: Apr. 18, 1995

[54] ROLLING MILL AND ROLLING METHOD

[75] Inventors: Yoshio Takakura, Hitachi; Toshiyuki Kajiwara, Tokyo; Hiroyuki Shiraiwa, Hitachi; Kenichi Yasuda, Katsuta; Yukio Hirama, Mito, all of Japan

[73] Assignee: Hitachi, Ltd., Tokyo, Japan

[21] Appl. No.: 935,421

[22] Filed: Aug. 26, 1992

[30] Foreign Application Priority Data

Aug. 26, 1991 [JP] Japan ..... 3-213370

[51] Int. Cl.[6] ..... B21B 13/14; B21B 37/08

[52] U.S. Cl. ..... 72/21; 72/241.8; 72/243.4

[58] Field of Search ..... 72/21, 241.2, 241.4, 72/241.6, 243.2, 243.4, 243.6, 241.8

[56] References Cited

U.S. PATENT DOCUMENTS

| | | | |
|---|---|---|---|
| 3,097,590 | 7/1963 | Justus | 100/155 |
| 4,369,646 | 1/1983 | Kajiwara . | |
| 4,631,948 | 12/1986 | Bald et al. . | |
| 4,691,548 | 9/1987 | Richter et al. . | |
| 4,724,698 | 2/1988 | Ginzburg | 72/243.4 |
| 5,007,273 | 4/1991 | Kummerhoff | 72/243.4 |

FOREIGN PATENT DOCUMENTS

| | | | |
|---|---|---|---|
| 0416880 | 3/1991 | European Pat. Off. . | |
| 0106412 | 7/1982 | Japan | 72/241.8 |
| 57-195523 | 12/1982 | Japan . | |
| 0003706 | 1/1983 | Japan | 72/243.4 |
| 60-18206 | 1/1985 | Japan . | |
| 0056715 | 3/1986 | Japan | 72/241.8 |
| 0189809 | 8/1986 | Japan | 72/241.2 |
| 63-60006 | 3/1988 | Japan . | |
| 1-180708 | 7/1989 | Japan . | |

*Primary Examiner*—Lowell A. Larson
*Assistant Examiner*—Thomas C. Schoeffler
*Attorney, Agent, or Firm*—Evenson McKeown Edwards & Lenahan

[57] ABSTRACT

A rolling mill has a work roll and a back-up roll for supporting the work roll vertically and driving it. A plurality of horizontal support rollers contact the work roll at barrel diameter outside the rolling region and at a both horizontal sides of the work roll and act to fix the position of the work roll in both horizontal directions during rolling and to oppose horizontal rolling forces. In order to reduce the bending of the work roll during rolling, there are provided means for applying horizontal counterbending forces to the work roll comprising members e.g. rollers, contacting the work roll at locations axially further from the rolling region than the support rollers and actuator means for urging the members against the work roll. The counterbending forces being in the same direction as the net horizontal force applied to said work roll by said back-up roll and the material being rolled. Preferably at least one condition of said work roll is sensed during rolling, and there are control means acting during rolling to control the counterbending forces in dependence on the sensed condition.

29 Claims, 10 Drawing Sheets

FIG. 5

| No | Support condition | Deflection state | Maximum deflection | Rigidity |
|---|---|---|---|---|
| i | Simple support | 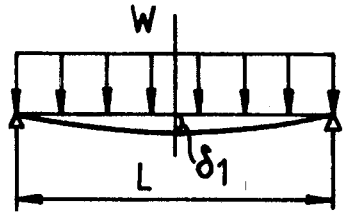 | $\delta_1 = \frac{5WL^4}{384E1}$ | 1 |
| ii | Rigid support | 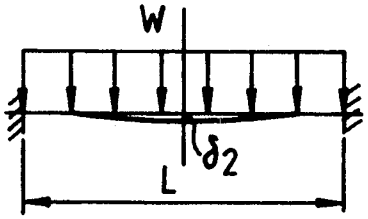 | $\delta_2 = \frac{WL^4}{384E1} = \frac{1}{5} \times \delta_1$ | 5 |
| iii | Multiple-row flexible support | 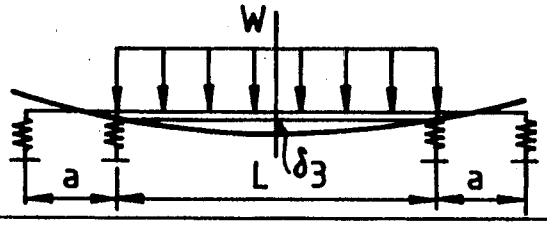 | $\delta_3 = (2\sim3) \times \frac{WL^4}{384E1} = \left(\frac{1}{2}\sim\frac{1}{3}\right) \times \delta_1$ | 2 ~ 3 |
| iv | Counter bending (control) | 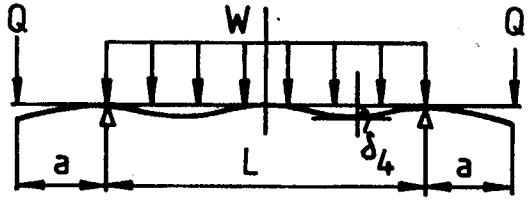 | $\delta_4 = \frac{1}{20} \times \frac{5WL^4}{384E1} = \frac{1}{20} \times \delta_1$ | 20 |

FIG. 10(contd)
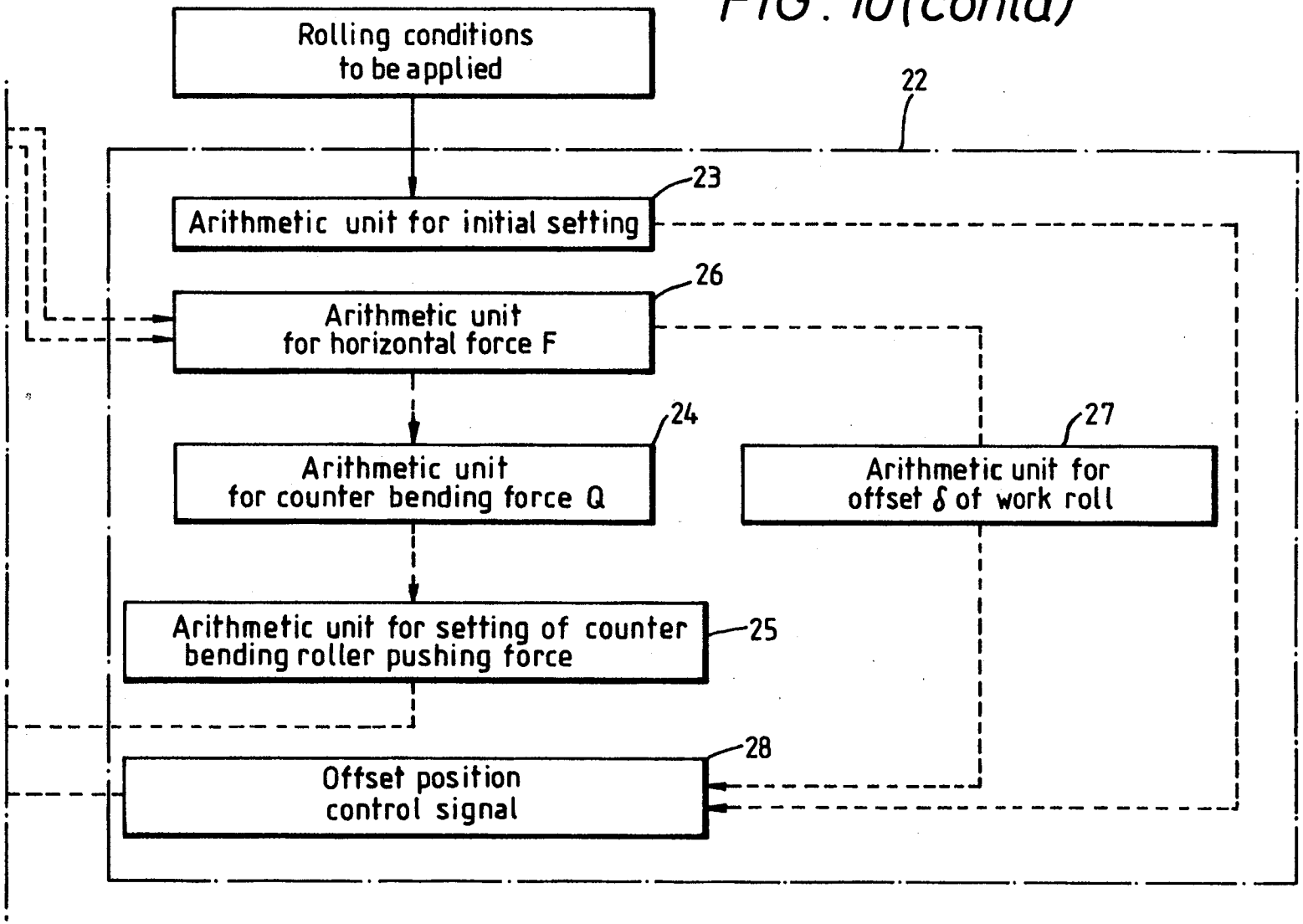

ROLLING MILL AND ROLLING METHOD

BACKGROUND AND SUMMARY OF THE INVENTION

The present invention relates to a rolling mill and rolling method, and more particularly to a rolling mill and a rolling method for metal strip, in which relatively small-diameter work rolls suitable for rolling hard, thin material are used. The invention is applied to the type of mill in which a work roll is supported vertically and driven by a back-up roll, for example, a six-high mill having intermediate back-up rolls and outer back-up rolls or a four-high mill having no intermediate back-up rolls.

A rolling mill for rolling metal strip, particularly hard, very thin material such as stainless steel, high carbon steel, spring steel and some alloy steels such as titanium alloy and high nickel alloy steels, uses small-diameter work rolls. Since such work rolls have too small a diameter to allow direct application of the rolling torque to them, there have been developed multiple-roll rolling mills such as the Sendzimir mill and other mills in which the drive is transmitted to the work rolls via one or more pairs of back-up rolls. Methods have also been developed for controlling the bending of the work rolls in such rolling mills, in order to achieve flatness of the product, by relative shifting of the back-up rolls in the axial direction and also by applying vertical roll bending forces to the work rolls and the back-up rolls (see e.g. U.S. Pat. No. 4,369,646).

The present invention is concerned with control of bending in the horizontal rolling direction i.e. in the direction of travel of the material being rolled. This direction is referred to herein as the "horizontal direction" or "horizontal rolling direction" and these expressions do not include the axial direction of the rolls.

Since bending of the work rolls in the horizontal direction increases with decrease of roll diameter, there is a limit on the reduction of roll diameter. The roll bending phenomenon in the horizontal direction is discussed more below.

U.S. Pat. No. 4,631,948 discloses a rolling mill in which drive is transmitted to the work rolls by back-up rolls, and the work rolls are offset from the vertical axial plane of the back-up rolls in the horizontal direction. It is known that horizontal bending of the work rolls is reduced by offsetting the work roll axial plane from the back-up roll axial plane in the direction downstream (in the rolling direction) from the back-up roll plane because the frictional force applied by the back-up rolls to the work rolls is then in opposition to the horizontal component of the rolling force (i.e. the force applied to the material being rolled by the work rolls). In U.S. Pat. No. 4,631,948, the work rolls are maintained in a fixed horizontal position in the mill frame, offset relative to the back-up rolls, and are supported in the horizontal direction by support rollers which contact the work rolls at portions thereof which are outside the region contacting the rolled material but are of the same diameter as that region (i.e. the barrel diameter). The support rollers, which are on both sides of the work rolls in the horizontal direction, are forced against the work rolls hydraulically and serve to control horizontal bending, by applying bending forces to the rolls horizontally between their fixed bearing blocks. It is stated that the hydraulic cylinders which push the support rollers are independently controlled to produce the desired bending. However, in this mill because the bearing blocks are in a fixed horizontal position in the mill frame, appropriate control of the horizontal forces, which vary in dependence not only on the rolling direction but also various other factors during rolling such as torque and rolling force, is not possible.

JP-A-63-60006 (1988) shows an arrangement closely similar to that of U.S. Pat. No. 4,361,948, in which again the bearing blocks of the work rolls are horizontally fixed during rolling.

JP-A-60-18206 (1985) shows a similar application of rollers to both sides of both ends of both work rolls, to provide horizontal support of the work rolls. In this case the rollers which are paired are applied by a mechanical adjustment system against the work rolls. All of the rollers are apparently adjustable in the horizontal direction, but there is no suggestion of control of the horizontal position of the work rolls which are shown with their axes in the vertical plane of the axes of back-up rolls. It is stated that the Journal bearings of the work rolls may be removed, presumably since all horizontal force is controlled by the rollers. The mechanical adjustment system shown is not suitable for application of roll-bending forces during rolling. This prior art disclosure suggests no solutions to the problems of control of horizontal roll bending.

Control of bending of the work rolls across the whole width of the work rolls is provided by a system of support rollers or bearing rollers, such as in a Sendzimir rolling mill mentioned above. While such an arrangement provides good horizontal support of the work roll, it has the problem that the presence of the spaced bearings causes marks on the work roll, leading to transfer marking of the rolled product. Another problem is that the support rolls interfere with cooling of the work rolls.

U.S. Pat. No. 4,691,548 describes a rolling mill, for example a four-high mill, in which inner and outer bearing blocks on reduced diameter journal portions of the work roll are independently adjustable in the horizontal direction by hydraulic piston-and-cylinder adjustment units. The aim is stated to be to compensate for horizontal forces and/or for strip thickness regulation while maintaining the horizontal bending curve of the work rolls required for planeness of the strip. Continuous calculation of the required settings of the adjustment units and corresponding adjustment is mentioned. A problem with such an arrangement is the high bending moment which must be applied to the reduced-diameter portion of the roll, and it is stated in this prior disclosure that this bending moment can be reduced by applying bending forces acting on the outer bearings in the direction of the linear load exerted by the horizontal rolling force, but at the same time this increases the stress on the inner bearings. Conversely, when the bending forces exerted by the outer bearings act in the opposite direction, the bearing stress of the roll is reduced, but the bending moments at critical locations of the rolls are increased. The document apparently fails to resolve this problem, and furthermore does not apparently seek to minimize roll bending at the rolling region.

EP-A-416880 (corresponding to Japanese patent applications Nos. 231602/89 and 235518/90) aims specifically to minimize bending of the work roll at the rolling region, and describes a mill in which there are support rollers contacting the work roll outside the rolling region at barrel diameter on both horizontal sides of the work roll, acting both to locate the work roll at the desired offset horizontal position (relative to the back-up roll plane) and to support the work roll against the horizontal rolling forces. Particularly when the support rollers have a greater axial length, it is considered that in this manner the effective rigidity of the work roll is improved, so that horizontal bending is reduced.

Further work by the present inventors has shown that in the support roller system of EP-A-461880 described above, the effective rigidity of the work roll can be improved up to only about half as much the rigidity obtaining in the state of a wholly rigid horizontal holding of the work roll portions outside the rolling region (called "rigid support" below), due to elastic deformation of the surface of the support rollers and their axial (hub) portions in whichever way the support is effected by a plurality of support rollers. Even if the horizontal deflection of the work rolls can be limited to a low level by the conjoint use of the reduction of the horizontal force by the offset of the work rolls, such an arrangement alone limits the possible reduction of the diameter of the work rolls. Moreover, this technique describes only the method of reducing the horizontal force and reducing the deflection of the work rolls when the horizontal force is applied, but does not consider an instability phenomenon arising with rolls of very much reduced diameter resulting from the interaction between the rolling load applied to the work rolls and the horizontal deflection. It does not at all describe means for preventing this instability phenomenon and making it possible to carry out stable rolling.

In order to carry out stable rolling, it is necessary to consider how important is the role which the horizontal deflection rigidity of the work rolls plays and what impedes the maximum improvement of this effective rigidity. However, the prior art as a whole has not sufficiently taken these factors into consideration and has therefore failed to accomplish maximum possible reduction of the diameter of the work rolls.

It is an object of the present invention to provide a rolling mill and rolling method which can further increase the effective rigidity of the work rolls and thereby can permit reduction of the diameter of the work rolls.

According to the invention in a first aspect, there is provided a rolling mill having a work roll, a back-up roll for supporting the work roll vertically and driving the work roll, and a plurality of horizontal support rollers contacting the work roll at barrel diameter outside the rolling region and at both horizontal sides of the work roll and acting to fix the position of the work roll in both horizontal directions during rolling and to oppose horizontal rolling forces. The rolling mill is characterized by means for applying horizontal counterbending forces to the work roll comprising members contacting the work roll at locations axially further from the rolling region than said support rollers and actuator means for urging the members against said work roll. The counterbending forces act in the same direction as the net horizontal force applied to the work roll by the back-up roll and the material being rolled.

The effect of counterbending forces is, in combination with the support rollers, to reduce the horizontal bending of the work roll, thereby increasing the effective rigidity of the work roll against rolling forces in the horizontal direction.

It is desirable to provide control of the counterbending forces during rolling. Preferably, therefore, the mill has sensing means for sensing at least one condition of the work roll during rolling, and control means acting during rolling to control the means for applying counterbending forces in dependence on the sensed condition. The condition or conditions sensed by the sensing means is selected from (i) horizontal deflection of the work roll and (ii) the net horizontal force applied to the roll by the back-up roll and the material being rolled.

Preferably the horizontal rolling forces applied to the work roll during rolling are balanced substantially only by forces applied by the support rollers and the means for applying counterbending forces.

Preferably, the members contacting the work roll of said means for applying counterbending forces comprise a plurality of counterbending rollers contacting the work roll at barrel diameter, and the actuator means move these counterbending rollers in the horizontal direction relative to the support rollers. To mount the support and counterbending rollers, preferably the mill has, at each horizontal side of the work roll, a rigid support member carrying the support roller or rollers and counterbending roller or rollers, the rigid support members being movable in order to adjust the horizontal position of the work roll, i.e. to provide a desired offset relative to the back-up roll.

In order to achieve accurate location of the work roll at a desired horizontal position, preferably at one horizontal side of the work roll, the support rollers are carried by first support means providing during rolling a predetermined horizontal position of the support rollers carried thereby and at the other horizontal side of the work roll the support rollers are carried by second support means. The rolling mill further has force-applying means acting on the second support means so as to apply a predetermined horizontal force to the work roll, via the support rollers, urging the work roll against the first support means.

In another aspect, the invention provides a rolling mill having a pair of opposed work rolls, a pair of back-up rolls for respectively supporting the work rolls vertically and driving the work rolls, a plurality of horizontal support rollers contacting the work rolls at barrel diameter outside the rolling region and at both horizontal sides of the work rolls and acting to fix the position of the work rolls in both horizontal directions during rolling and to oppose horizontal rolling forces. There are respective means for applying horizontal counterbending forces to the two work rolls comprising, in each case, members contacting the work roll at locations axially further from the rolling region than the support rollers and actuator means for urging said members against the work roll. The counterbending forces act in the same horizontal direction as the net horizontal force applied to the work roll by the respective back-up roll and the material being rolled. There are further provided control means arranged for controlling the respective actuator means to apply the counterbending forces to the respective the work roll independently of the counterbending forces applied to the other work roll, so that for each work roll the counterbending forces applied are in the same horizontal direction as the net horizontal force.

In yet another aspect, the invention provides a method of control of a rolling mill in which a work roll is supported vertically and driven by a back-up roll and is positioned horizontally and supported horizontally by support rollers contacting the work roll at locations at barrel diameter outside the rolling region. The method is characterized by, during rolling, applying counterbending forces at locations axially outside or inside the support rollers in dependence on at least one of the quantities (a) horizontal deflection of the work roll and (b) horizontal force acting on the work roll, the counterbending forces acting in the same direction as the net horizontal force applied to the work roll by the back-up roll and the rolled material. The method preferably further includes shifting said work roll horizontally to a predetermined position for rolling by moving said support rollers.

The invention provides a method of operation of a rolling mill in which a work roll is supported vertically and driven by a back-up roll, the method comprising locating the work roll horizontally and supporting it against horizontal rolling forces by means of support rollers contacting the work roll at a barrel diameter outside the rolling region and applying horizontal counterbending forces tending to reduce horizontal bending of the work roll by means of counterbending rollers also contacting the work roll at a barrel diameter at locations axially further or closer from the rolling region than the support rollers, the counterbending rollers being movable in the horizontal direction relative to the support rollers.

In another aspect, the invention provides a method of control of a rolling mill in which two opposed work rolls are supported vertically and driven by respective back-up rolls, the method comprising during rolling controlling horizontal bending of the two work rolls so as to reduce bending of each roll by applying horizontal roll-bending forces to the two work rolls independently in dependence on at least one sensed condition of each work roll.

Other objects, advantages and novel features of the present invention will become apparent from the following detailed description of the invention when considered in conjunction with the accompanying drawings.

BRIEF DESCRIPTION OF THE DRAWINGS

Embodiments of the invention are described below by way of non-limitative example, with reference to the accompanying diagrammatic drawings, in which:

FIG. 5 is a diagram showing modes in which deflection and rigidity can vary according to support conditions of end portions of a work roll.

DESCRIPTION OF THE PREFERRED EMBODIMENTS

By the present invention, the effective rigidity of the work rolls can be remarkably increased, permitting the diameter of the work rolls to be much reduced to the minimum. The principle behind the invention will be explained before the specific embodiments are described.

Figure 4A:
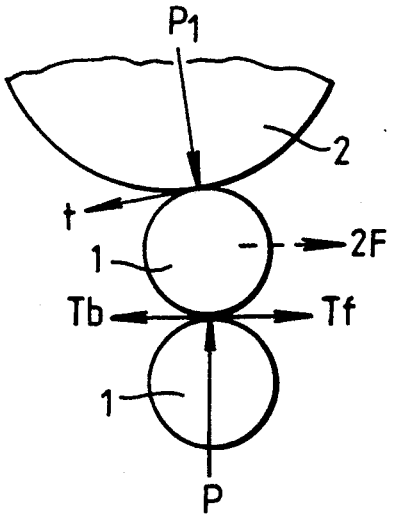
FIGS. 4(*a*), 4(*b*) and 4(*c*) show forces applied to the work roll, wherein FIG. 4(*a*) is a view showing the state in which no horizontal deflection exists, FIG. 4(*b*) is a view showing the state in which a horizontal deflection exists, and FIG. 4(*c*) is a view of FIG. 4(*b*) from above.
Figure 4B:
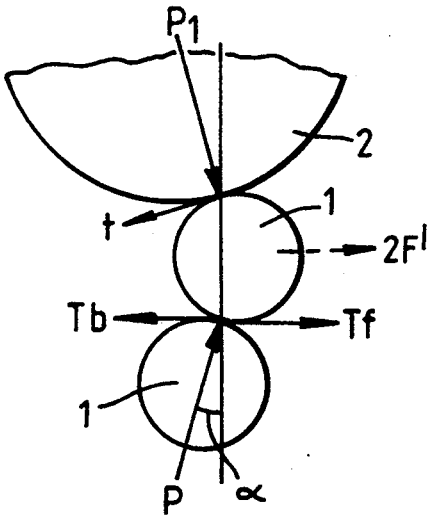
Figure 4C:
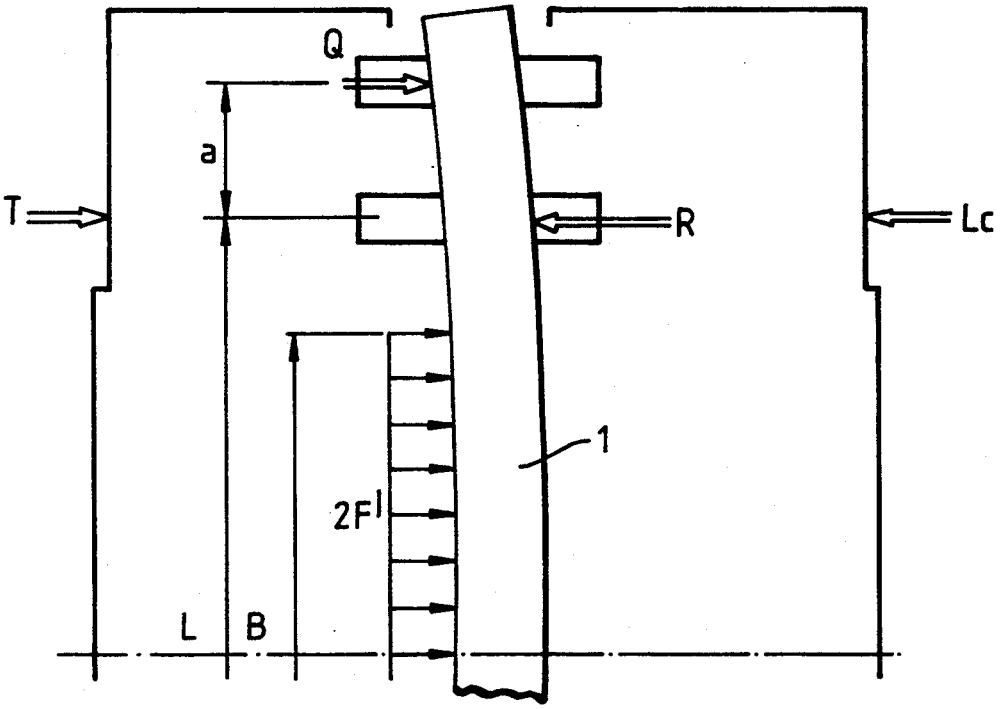

First, the role played by the rigidity of the work roll will be explained with reference to FIG. 4. In the state shown in FIG. 4(*a*) where no horizontal deflection exists, the horizontal force (2F) applied to one work roll is the sum of a horizontal component of the reaction $P_1$ of the rolling load from an intermediate back-up roll 2, the driving force t and the difference between the longitudinal tensile forces Tb, Tf of the material being rolled. However, when this work roll undergoes deflection relative to the other work roll due to this horizontal force (FIGS. 4(*b*) and (*c*)), the horizontal component of the rolling load P is added to the forces described above and results in the further increase of the horizontal deflection. (Since the diameter of the work roll is small, even a limited horizontal deflection makes this component large.) This in turn increases the component of force of the rolling load P and if this goes out of balance with the bending rigidity of the work roll, the horizontal deflection becomes $\infty$ and so-called "buckling" occurs. However, if the horizontal bending rigidity of the work roll is large, the work roll stabilizes at a certain deflected position, so that rolling can be carried out. As a result of theoretical studies and actual measurements, it has been found out that the rolling load at the limit at which the work roll buckles in the horizontal direction is proportional to the horizontal deflection rigidity. For this reason, how to increase this effective rigidity of the work roll poses the greatest problem in accomplishing the reduction of the diameter of the work roll.

The method disclosed in EP-A-416880 minimizes the support span by supporting the work roll at positions just outside the maximum sheet width (rolling region) and attempts to establish the state of rigid support by supporting the work rolls by double support rollers on each side. According to the theoretical and experimental verification carried out by the present inventors, the state of such rigid support cannot be established due to the elastic deformation of the surface and axial portions of the support rollers, and the limit of the rigidity is at most 40 to 60% of that of the state of rigid support, as mentioned above. (This corresponds to two to three times the rigidity of simple support. When the rigid support can be accomplished, the rigidity can be improved up to five times that of simple support. Simple support is support at two points only.) The reduction of the diameter of the work roll due to this improvement in the rigidity will be examined. Since the rigidity is proportional to the fourth power of the work roll diameter $d_w$, the roll diameter in the case of support by a plurality support rollers on each side becomes a biquadratic root of (0.4–0.6), i.e. (0.8–0.88) with respect to the roll diameter in the case of the simple support, and reduction of the roll diameter by only 20 to 12% can be accomplished. (Incidentally, if the condition of rigid support can be accomplished, the roll diameter becomes a biquadratic root of (1/5), i.e. (0.67), and the reduction of the roll diameter by 33% can be accomplished.)

FIG. 5 shows at (i) and (ii) simple support and rigid support and in (iii) a condition of flexible support corresponding to EP-A-416880.

Even in the case of rigid support, deflection $\delta_2$ exists at the center as can be clearly seen from FIG. 5. If counterbending is applied according to the present invention as represented by FIG. 5(iv), deflection can be remarkably reduced and effective rigidity can in principle be increased by as much as four times that of the rigid support (20 times that of the simple support), and the work roll diameter can be reduced to the biquadratic root of (1/20) of the simple support, i.e. (0.47). Thus, the roll diameter can in principle be reduced by as much as 53%.

As explained above, the horizontal deflection rigidity can be increased by delicately controlling the horizontal deflection and as a result, the reduction of the work roll diameter can be accomplished. It is desirable always to carry out this delicate control of the horizontal deflection. When the diameter of the work roll is reduced to the minimum, the natural rigidity becomes extremely small and is about 1/20 of that of the case of simple support, for example. Even a slight control delay may lead to a large horizontal deflection of the work roll. As a result, the deflection cannot instantaneously be returned to zero by the counterbending force because the component of force of the horizontal force due to the rolling load increases and because the work rolls are in contact with intermediate back-up rolls (or reinforcing rolls) and with the material being rolled. If the component of force of the rolling load dominates, the horizontal deflection of the work rolls increases and rolling finally becomes impossible. Therefore, it is very desirable to always control the horizontal deflection with quick response.

Figure 1:
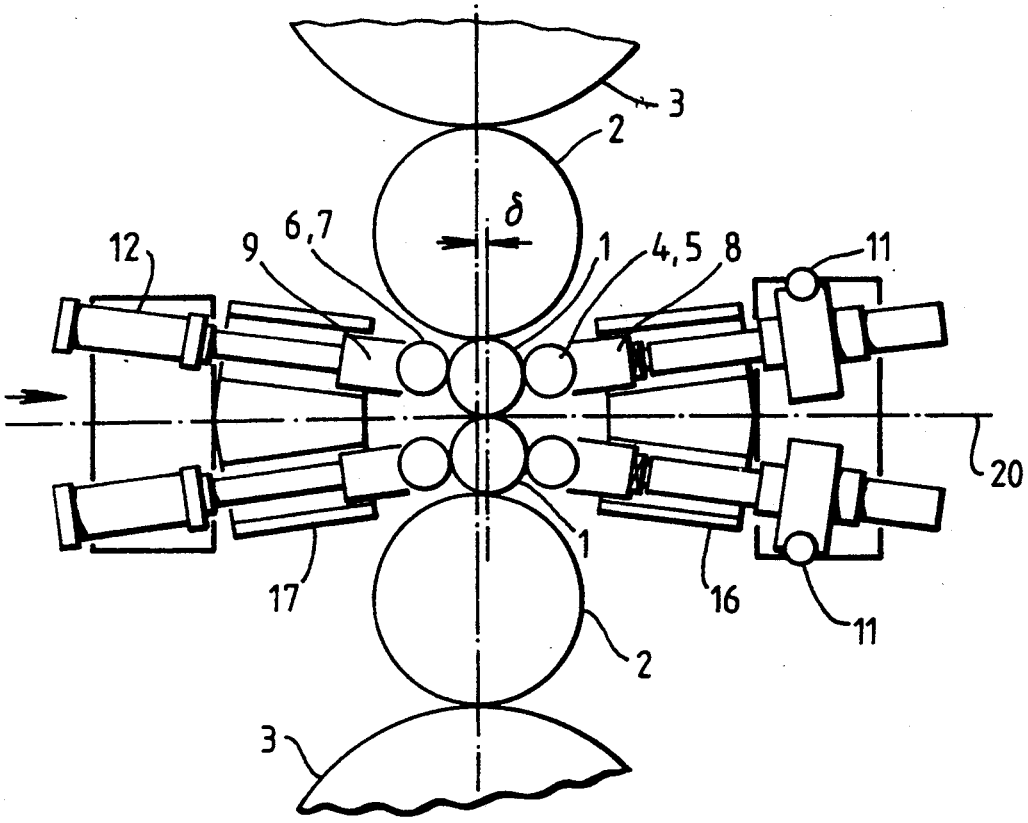
FIG. 1 is a vertical sectional view showing an embodiment of the rolling mill of the present invention.
Figure 2:
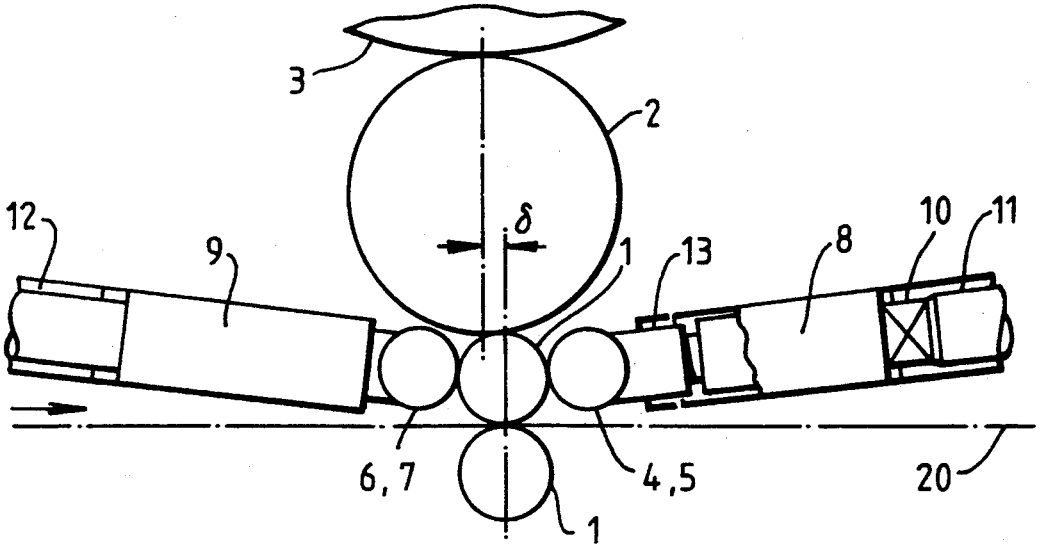
FIG. 2 is an enlarged view in vertical section of an upper work roll portion of the rolling mill shown in FIG. 1.
Figure 3:
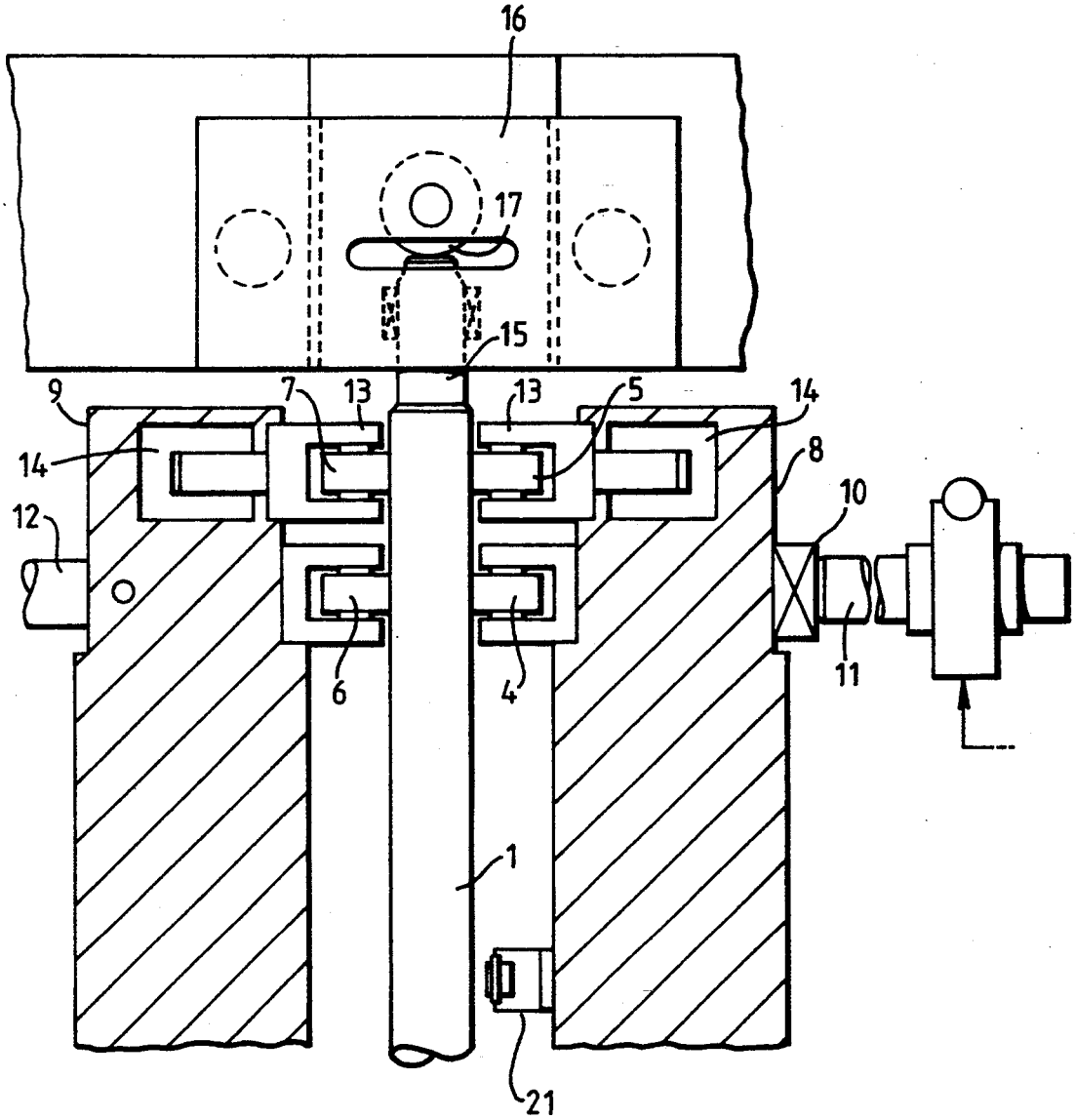
FIG. 3 is a plan view of part of the upper work roll portion shown in FIG. 2.

FIGS. 1 to 3 show diagrammatically an embodiment of a rolling mill according to the present invention. The rolling mill shown in FIGS. 1 to 3 is a typical six-high rolling mill. Work rolls 1 are above and below a strip material 20 being rolled, and intermediate back-up rolls 2 and outer back-up rolls 3 are disposed above and below the work rolls 1. Generally, the diameter of the work roll 1 is so small that torque necessary for rolling cannot be applied directly to it. Therefore, the torque is appled to the intermediate rolls 2 (or to the outer rolls 3) and is transmitted to the work rolls 1.

The roll drum portion of each work roll 1 outside the maximum sheet width of the rolled material 20 is supported at barrel diameter (i.e. the rolling diameter) by a plurality of rollers 4, 5, 6, 7 on the inlet and outlet sides of the work roll. The horizontal forces applied in the horizontal direction to the work roll 1 are supported only by the rollers 4, 5, 6, 7. As FIG. 3 shows, at each end of each roll 1 there are four rollers 4, 5, 6, 7, two on each horizontal side. Rollers 4, 6 here act as support and positioning rollers, and the outer rollers 5, 7 act as counterbending rollers. The inner support rollers 4, 6 are mounted on rigid beams 8, 9, respectively on opposite horizontal sides of the work roll extending parallel to the work roll. The outer support rollers 5, 7 are movable relative to the beams 8, 9 to push the work rolls 1 by hydraulic piston-and-cylinder units 14 fitted to the rigid beams through bearings 13. The rigid beam 8 at one side is guided inside a guide 16 and is supported by a mechanical positioning device 11 having a motor-driven gear driving a screw spindle (similar to those disclosed in EP-A-416880) through a load cell 10, and the rigid beam 9 supporting the other rollers 6, 7 is guided inside a guide 17 and is pushed towards the work roll 1 by a hydraulic piston-and-cylinder unit 12. An oil pressure sensor (not shown in the drawing) is fitted to the hydraulic cylinder 12 to measure the pushing force. A gap sensor (i.e. a roll displacement sensor) 21 is fitted to the rigid beam 8 to measure the horizontal deflection of the work roll 1 at the center thereof.

In order to regulate horizontal offset of the work roll 1, the work roll 1 in the rolling mill described above is so arranged as to be movable in the horizontal direction so that offset can be made in the pass direction of the rolled material 20. Thus, as shown in FIG. 3 the reduced diameter end portions 15 of the work rolls are journalled in horizontally slidable bearing blocks 16, which are restrained vertically. A rolling bearing 17 applies axial restraint. Vertical roll bending forces may be applied through the bearing blocks 16. Horizontal positioning and restraint of the work roll 1 is effected by the support rollers 4, 6, by movement and positioning of the beams 8, 9.

The cylinders 14 applying the counterbending forces can be replaced by a mechanical motor-driven gear drive.

Next, the rolling method in the rolling mill having the construction described above will be explained.

The present invention provides counterbending forces to cope with the horizontal force of the work roll, and remarkably increases effective horizontal deflection rigidity. As explained already, it is desirable in the method of the invention to always control the horizontal deflection with a quick response. Therefore, it is necessary either to detect the horizontal force acting on the work roll, or to detect the horizontal deflection of the work roll and to feed it back to the means applying the counterbending forces.

First of all, a method of detecting the horizontal force applied to the work roll and controlling the counterbending force accordingly will be explained.

Figure 6:
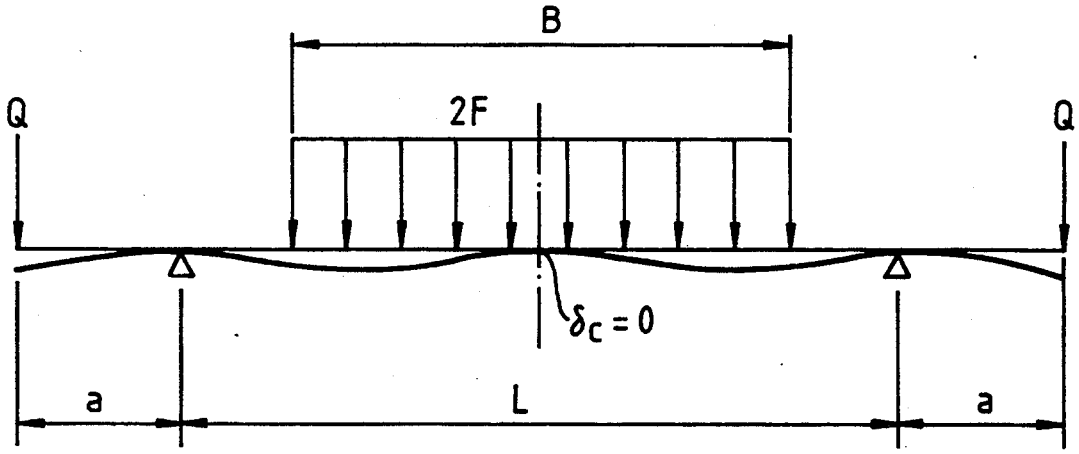
FIG. 6 is a diagram showing the deflection state with counterbending forces applied under actual load conditions.

In FIG. 6, the counter bending force Q necessary to make the zero deflection $\delta_c$ at the center can be determined in the following way.

In the formula:

$$Q = \frac{1}{4.8} \times \frac{L}{a} \times f\left[\frac{B}{L}\right] \times F \qquad \text{(formula 1)}$$

L is the length of span between the support rollers 4 (or 6) on opposite sides of the rolling region, a is the distance of the counterbending roller 5 (or 7) from the adjacent support roller 4 (or 6), B is the sheet width of the rolled material, 2F is the total horizontal force applied to the work roll, and f(B/L) can be calculated from the following formula.

$$f(B/L) = \frac{1}{5}\left\{8 - 4\left[\frac{B}{L}\right]^2 + \left[\frac{B}{L}\right]^3\right\} \qquad \text{(formula 2)}$$

Figure 7:
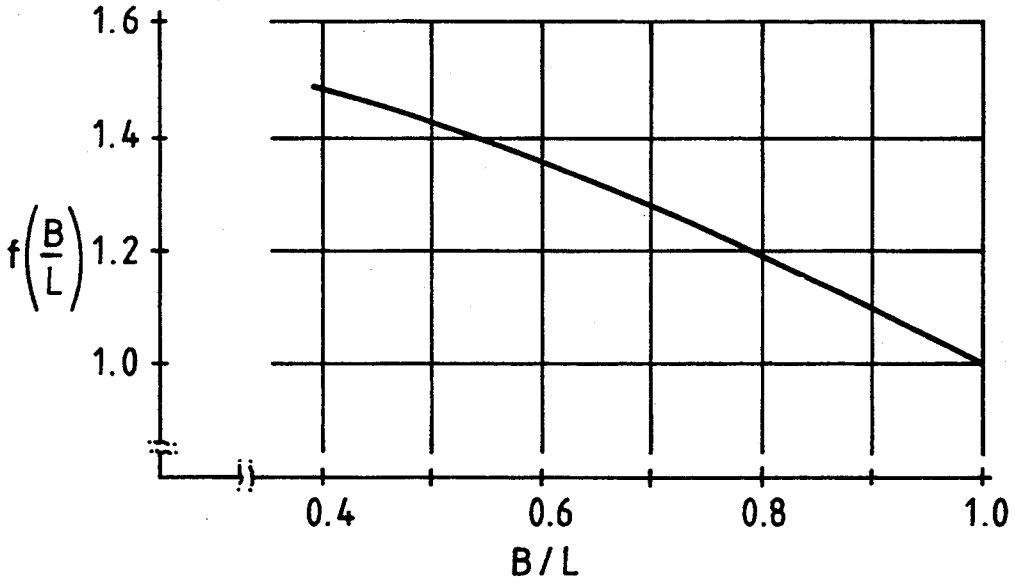
FIG. 7 is a graph showing the value of a function f(B/L).

For the particular embodiment illustrated herein, f(B/L) assumes a value within the range of 1.0 to 1.5 as shown in FIG. 7.

In formula (1), the sheet width B is known in a practical operation. Therefore, the counterbending force Q can be known if the horizontal force F of the work roll is known. In practice, this horizontal force F is determined by the following formula because the load cell load $L_c$ and hydraulic cylinder force T shown in FIG. 4(*c*) can be measured by the load cell 10 shown in FIG. 3 and by an oil pressure sensor (not shown in the drawing) of the hydraulic cylinder 12.

$F = L_c - T$ *TM (formula* 3)

(Push forces R, Q between the rollers and the rolls and the force of each hydraulic cylinder 14 for the counterbending rollers 5, 7 are internal forces and may be excluded from the calculation of the horizontal force on the work roll 1. Therefore, the horizontal force 2F on the work roll 1 can be determined as the difference between the load cell load $L_c$ and the hydraulic cylinder force T).

As described above, the force Q necessary for counterbending can be continuously or intermittently determined by measuring the load $L_c$ and T, and can thus be controlled as desired.

When some control delay is permitted, the horizontal deflection of the work roll can be limited to an extremely low level by measuring the actual horizontal deflection of the work roll by a gap sensor 21 as shown in FIG. 3 and adjusting the counterbending force Q so that this horizontal deflection becomes small. As a result, a reduction of the diameter of the work roll can be accomplished.

Table 1 represents an example of numerical calculation demonstrating how the diameter of the work roll can be reduced in accordance with the present invention.

TABLE 1

| No. | System | Distance between support points | Support condition | | Working roll diameter |
|---|---|---|---|---|---|
| | | | support | rigidity | |
| 1 | work roll fixed by bearing | 1.5 | free | 1 | 100 |
| 2 | reduction of distance between support points | 1.1 | semi-fixed | 2~3 | 62~56 |
| 3 | reduction of distance between support points | 1.1 | fixed | 5 | 49 |
| 4 | This invention | 1.1 | counter bending (control) | 20 | 35 |

The distance (L) between the support rollers is proportional to the one-fourth power of the rigidity, the support condition to the first power of the rigidity, and the roll diameter to the one-fourth power of the rigidity. If the effective rigidity is to be kept the same while the work roll diameter is reduced, therefore, L is proportional to the roll diameter and the support condition to the fourth power of the roll diameter.

In this way, the present invention can permit much more reduction of the diameter of the work roll than the prior art methods by a system which does not impart any surface flaws to the work roll in the rolling region by means of the support rollers in the horizontal direction, and the rolling operation of ultra-thin, hard materials having high surface quality can be carried out stably.

Next, offset of the work roll will be explained.

If the horizontal force of the work roll is excessively great, $\delta_4$ in item (iv) of FIG. 5 which is the residual deflection after counterbending becomes great, too, in proportion to this horizontal force, and a shape defect of the rolled material will occur. Also, the counterbending force becomes excessive and encounters various practical problems such as a limitation of the dimension of the hydraulic cylinder 14, excessive bending stress of the work roll, reduction of the service life of the bearings of the rollers, and so forth. Accordingly, the reduction of this horizontal force is very important. As described in EP-A-416880, this can be accomplished by offsetting the work rolls from the axial plane of the back-up rolls. The offset quantity $\delta$ can be regulated by the beam positioning device 11. When the offset quantity $\delta$ is regulated, the component of the force $P_1$ from the intermediate back-up roll in the horizontal direction can be regulated as can be understood from FIG. 4(*a*).

In the embodiment of the present invention, a plurality of rollers 4, 5, 6, 7 provide the horizontal support force. Therefore, the rigid beams 8 and 9 capable of withstanding these bending moments are employed. Accordingly, the counterbending force can be imparted to the work roll.

Though the explanation given above relates to the six-high rolling mill, the present invention can obviously be applied to a four-high rolling mill not having intermediate back-up rollers, or to a vertically asymmetric rolling mill using a work roll of a reduced diameter for only the upper or lower side.

In summary, with the rolling mill and rolling method of the present invention described above, the effective rigidity of the work roll can be remarkably improved and moreover, the diameter of the work roll can be greatly reduced. Accordingly, even when rolling is carried out by the use of work rolls having a small diameter, the net horizontal bending force of the work rolls can be reduced and a high rigidity can be secured against horizontal bending. Therefore, the present invention provides the benefit that rolling can be made stably, and the production of a hard and ultra-thin material can be achieved highly efficiently.

Figure 8:
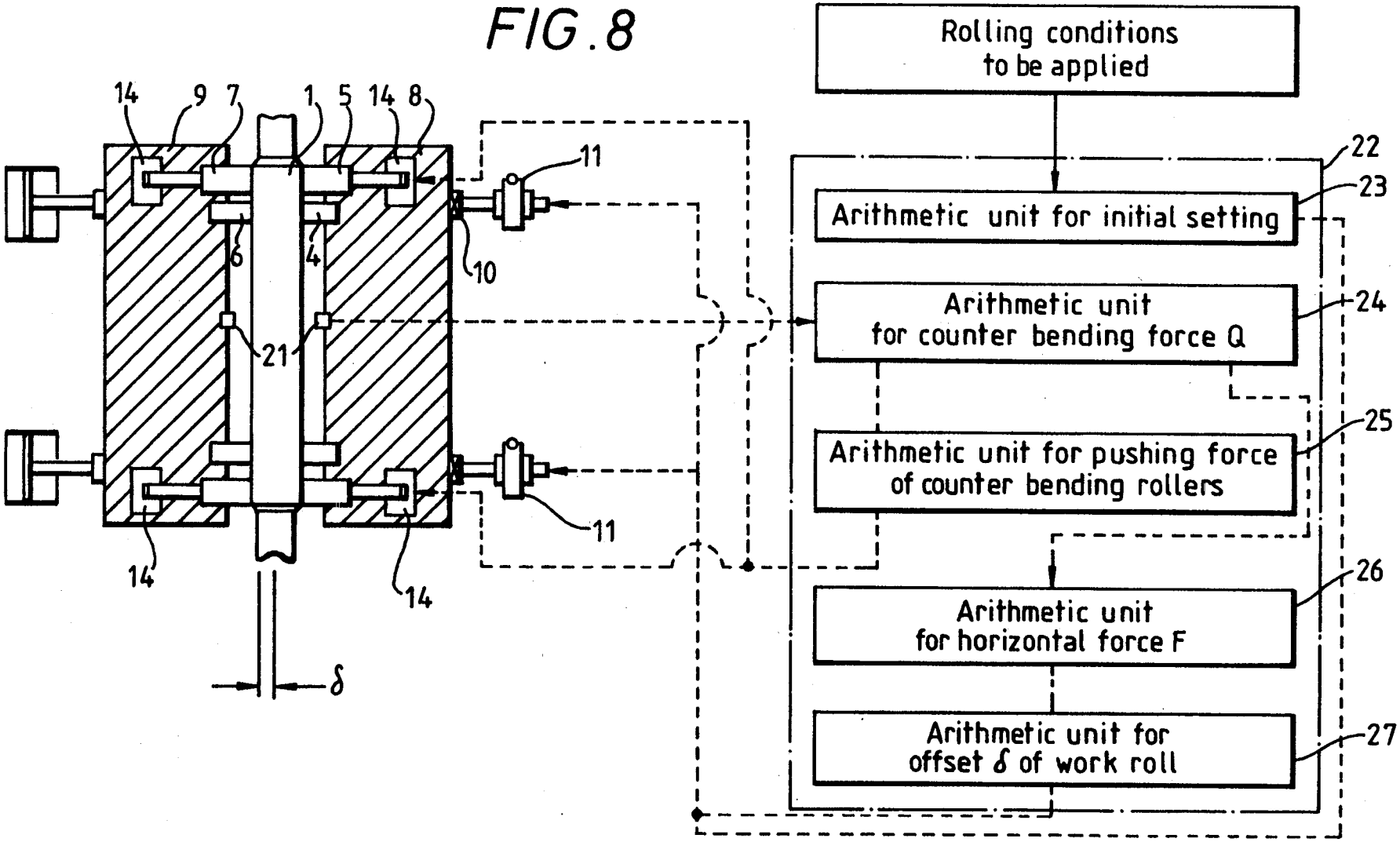
FIG. 8 is a view corresponding to FIG. 3 showing additionally a first controller in diagram form.

FIG. 8 shows as a block diagram a controller 22 of the rolling mill of FIG. 3, which calculates and controls the counterbending forces applied by the counterbending rollers 5,7. The controller 22, which is a data-processing unit, receives as input information the predetermined desired rolling conditions of the mill for the material being rolled. The controller has an arithmetic unit 23 which from the input information calculates the initial setting of the mill. Secondly there is an arithmetic unit 24 which receives the output of the gap sensor 21 indicating the degree of bending of the work roll 1 during rolling and calculates therefrom the required counterbending force Q. From the output of the unit 24, an arithmetic unit 25 calculates and controls the pushing force of the cylinders 14 which act on the counterbending rollers 5. A further arithmetic unit 26 calculates the horizontal force F and another arithmetic unit 27 calculates the offset signal for the offset $\delta$ of the work roll, which is used to control the positioning means 11 for the beams 8,9 so that the support rollers 4,6 locate the roll 1 at the desired position.

Figure 9:
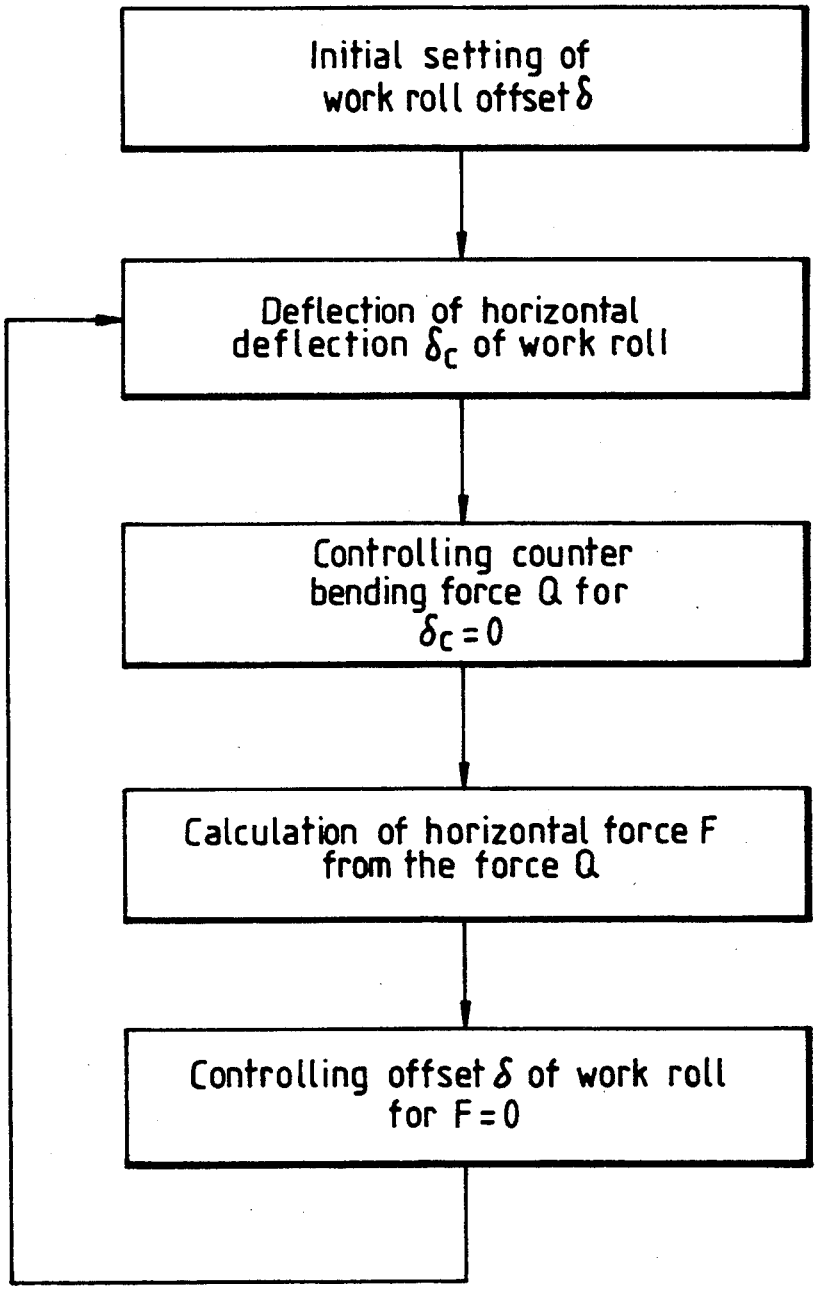
FIG. 9 is a diagram of control by the controller of FIG. 8.

The calculation and control method is illustrated by FIG. 9 and is as follows. The work roll is initially offset by $\delta$ so that the horizontal force F on the work roll will be minimum. When the rolling operation starts, the horizontal deflection $\delta_c$ is detected by the sensor 21, and feedback control of the counterbending force Q is effected so that $\delta_c=0$. On the other hand, during the above-mentioned control, horizontal force is calculated from the counterbending force Q according to the formula 1 above. The work roll offset signal $\delta$ is then controlled so that the horizontal force F will be small. Namely, since a horizontal component of rolling load from the intermediate roll 2 changes depending on the offset $\delta$, the horizontal force F can be expressed as a function of the horizontal component of rolling load due to offset, horizontal force (tangential force) applied to the work roll by the driving of the intermediate roll, difference in tension during rolling and horizontal force caused by horizontal deflection of the work roll:

$$2F=P\cdot\delta\cdot\{2/(dw+di)\}-t+\tfrac{1}{2}\cdot(Tf-Tb)+\alpha\cdot P\cdot\delta_c\cdot\{2/(dw+di)\} \quad \text{formula 4}$$

where dw is the diameter of the work roll and di is the diameter of the intermediate roll and a is a coefficient which approximately equals 0.67.

Figure 10:
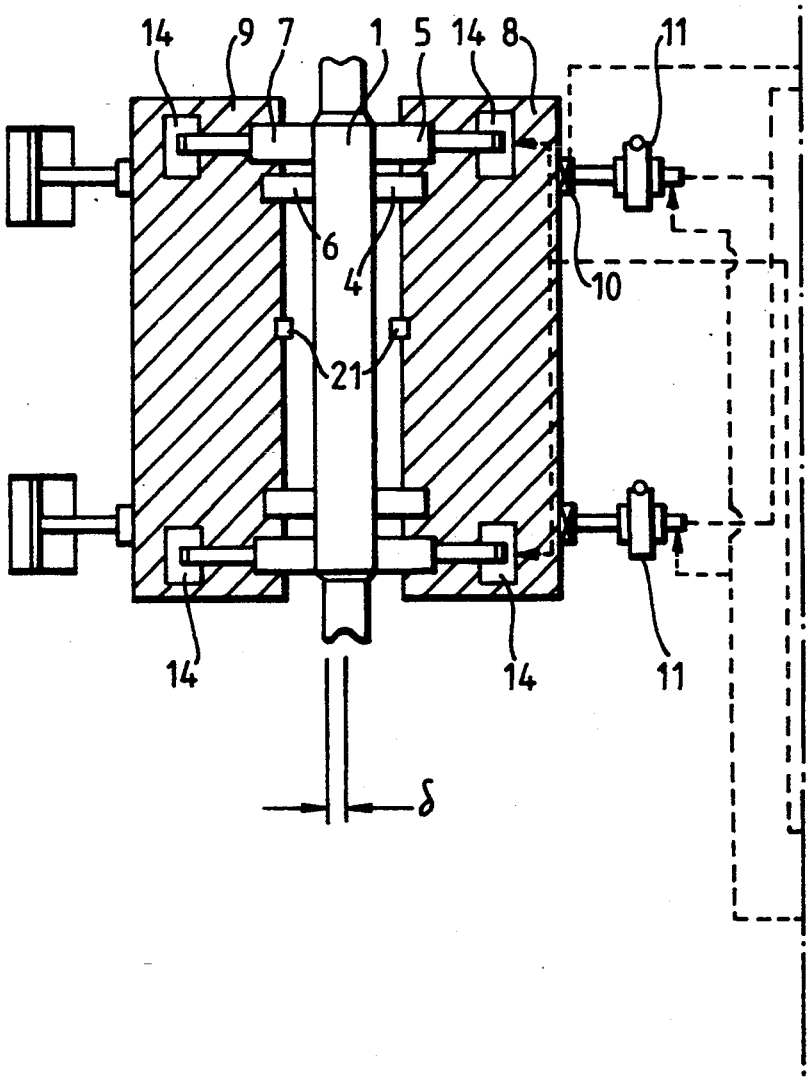
FIG. 10 is a view corresponding to FIG. 3 showing additionally another controller in diagram form.

FIG. 10 shows an alternative embodiment of the controller 22 of the rolling mill of FIG. 3. An arithmetic unit 23 receives input information of the rolling conditions to be applied, and provides an output signal for the initial mill setting to an offset position control signal calculator 28. An arithmetic unit 26 calculates the horizontal force F from signals from the load cell 10 and the positioning means 11. This unit 26 is connected to an arithmetic unit 24 for calculating the required counterbending force Q and to an arithmetic unit 27 for calculating the offset $\delta$ of the work roll 1. The output of the unit 24 passes to an arithmetic unit for setting and controlling the counterbending roller pushing force through the cylinders 14. The arithmetic unit 28 receives data from the units 23 and 27 and provides an offset position control signal to the positioning means 11.

Figure 11:
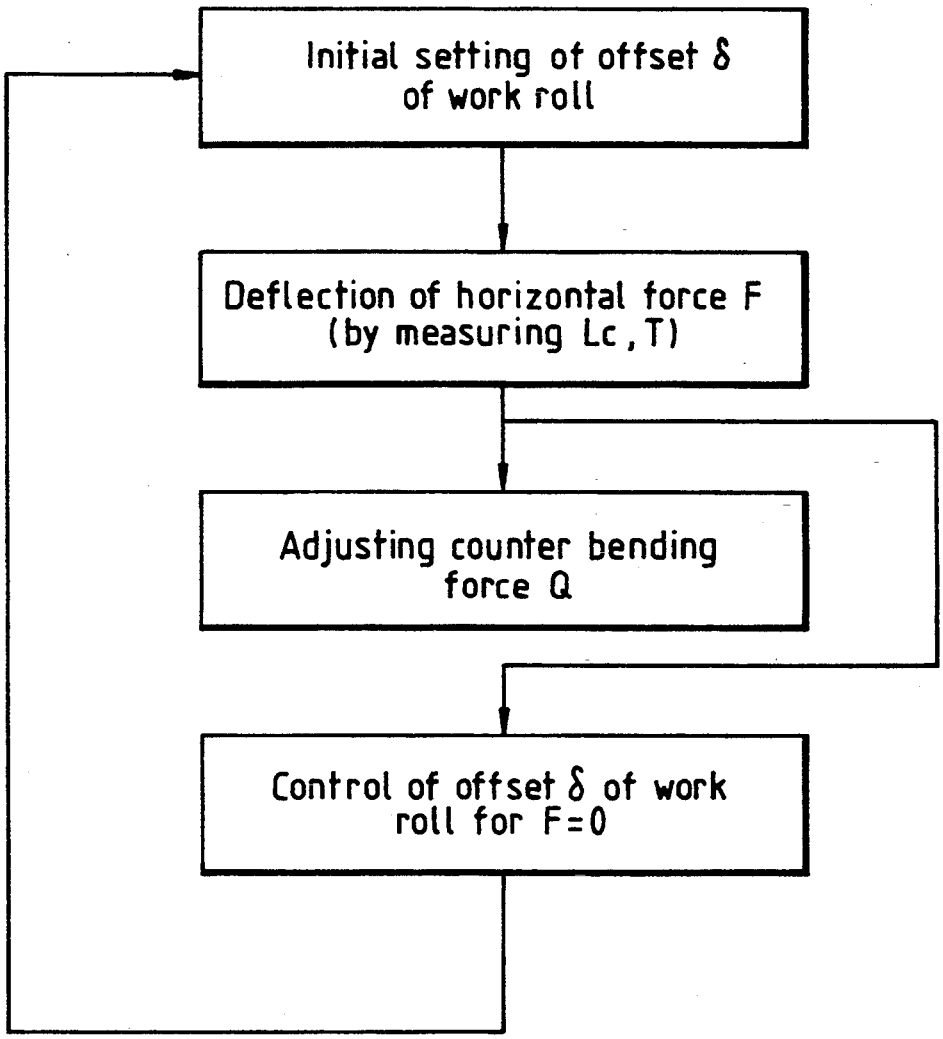
FIG. 11 is a diagram of control by the controller of FIG. 10

The method of control effected by the controller 22 of FIG. 10 is illustrated by FIG. 11 and is as follows. The horizontal forces Lc, T are measured, and the horizontal force F is obtained through calculation according to formula 3. The counterbending force Q is controlled depending on the horizontal force F on the basis of formula 1. The offset signal 6 is controlled according to equation 4 so that the horizontal force F will be small.

Although for simplicity, FIGS. 8 and 10 show counterbending forces and their control applied only to one horizontal side of the work roll 1, the same principle is applied in practice to both sides, as required.

In a specific embodiment of the invention, using the apparatus of FIG. 1, the following rolling was conducted. The maximum strip width was 1050 mm, and the work roll barrel diameter 110 mm. The barrel diameter length of the work roll was 1520 mm. The distance L between the support rollers was 1100 mm and the distance a to the counterbending rollers from the support rollers was 180 mm. The rolling load P was a maximum of 1000 tons. By control of the offset $\delta$, and the counterbending force Q, the horizontal force F was limited to a maximum of 10 tons. Typically the value of Q was 12 tons. The value of $\delta_c$ was controlled to be zero.

The invention can especially be used to produce thin strip which is required to have high brilliancy, so that it is very suitable for rolling stainless steel. In many cases the thickness is 1 mm or less, and the degree of reduction is 5–30%.

What is claimed is:

1. A rolling mill having a work roll, a back-up roll for supporting said work roll vertically and driving said work roll, a plurality of horizontal support rollers contacting said work roll at its barrel circumference locations outside a predetermined rolling region and at both horizontal sides of the work roll and acting to fix a position of the work roll in both horizontal directions during rolling and to oppose horizontal rolling forces, and counterbending apparatus for applying horizontal counterbending forces to said work roll, said counterbending apparatus comprising counterbending members contacting the work roll at barrel circumference locations axially further from the rolling region than said support rollers and counterbending actuator apparatus for urging said counterbending members against said work roll to apply counterbending forces in a same direction as horizontal force applied to said work roll by said back-up roll and material being rolled with offsetting forces applied by the support rollers and the counterbending members serving to minimize horizontal bending of the work rolls during rolling operations to thereby increase effective rigidity of the work rolls.

2. A rolling mill according to claim 1, wherein said counterbending apparatus includes sensing apparatus for providing a sensed condition by sensing at least one condition of said work roll during rolling, and control apparatus acting during rolling to control said counterbending actuator apparatus in dependence on the sensed condition.

3. A rolling mill according to claim 2, wherein said at least one condition sensed by said sensing apparatus is selected from (i) horizontal deflection of said work roll and (ii) said net horizontal force applied to said work roll by said back-up roll and the material being rolled.

4. A rolling mill according to claim 1, wherein said counterbending members comprise a plurality of counterbending rollers contacting the work roll at a part of its barrel circumference, and wherein said counterbending actuator apparatus moves said counterbending rollers in the horizontal direction relative to said support rollers.

5. A rolling mill according to claim 4, wherein said counterbending members engage said work roll at positions which are further from the rolling region than are the support rollers.

6. A rolling mill according to claim 4, having at each horizontal side of said work roll a rigid support member carrying at least one said support roller and at least one said counterbending roller, said rigid support members being movable in order to adjust the horizontal position of said work roll.

7. A rolling mill according to claim 6, wherein for each said counterbending roller, said counterbending actuator apparatus comprises a hydraulic piston-and-cylinder unit mounted on the respective said rigid support member.

8. A rolling mill according to claim 6, wherein each said rigid support member carries two said support rollers which contact said work roll on opposite axial sides of said rolling region and two said counterbending rollers which contact said work roll on opposite axial sides of said rolling region.

9. A rolling mill according to claim 1, wherein at one horizontal side of said work roll said support rollers are carried by a first support providing during rolling a predetermined horizontal position of said support rollers carried thereby and at the other horizontal side of said work roll said support rollers are carried by a second support, the rolling mill further having a force-applying device acting on said second support so as to apply a predetermined horizontal force to said work roll, via said support rollers, urging the work roll against said first support.

10. A rolling mill according to claim 9, wherein said force-applying device comprises at least one hydraulic piston-and-cylinder unit.

11. A rolling mill according to claim 9, wherein position of said first support is adjustable horizontally.

12. A rolling mill according to claim 9, having a load cell arranged to detect force applied to said work roll by said second support, sensing apparatus for sensing said predetermined force of said force-applying device, and control apparatus for controlling said counterbending actuator apparatus in dependence on forces sensed by said load cell and said sensing apparatus.

13. A rolling mill according to claim 9, wherein said counterbending members engage said work roll at positions which are further from the rolling region than are the support rollers.

14. A rolling mill according to claim 1, wherein said support rollers are adjustable in the horizontal direction in order to locate said work roll at a predetermined horizontal position.

15. A rolling mill according to claim 1, wherein horizontal rolling forces applied to said work roll during rolling are balanced substantially only by forces applied by said support rollers and counterbending apparatus.

16. A rolling mill according to claim 1, wherein said counterbending members engage said work roll at positions which are further from the rolling region than are the support rollers.

17. A rolling mill having a work roll, a back-up roll for supporting said work roll vertically and driving said work roll, a plurality of horizontal support rollers contacting said work roll at barrel circumference locations outside a predetermined rolling region and at both horizontal sides of the work roll and acting to fix a position of the work roll in both horizontal directions during rolling and to oppose horizontal rolling forces, a plurality of counterbending rollers contacting said work roll at barrel circumference locations axially further from said rolling region than said support rollers and at both horizontal sides of said work roll, and counterbending actuator apparatus for said counterbending rollers for moving said counterbending rollers relative to said support rollers and urging said counterbending rollers against said work roll to apply horizontal counterbending forces thereto with offsetting forces applied by the support rollers and the counterbending rollers serving to minimize horizontal bending of the work rolls during rollings to thereby increase effective rigidity of the work rolls.

18. A rolling mill according to claim 17, having at each horizontal side of said work roll a support member carrying said support rollers on that side, said counterbending rollers on that side and said counterbending actuator apparatus.

19. A rolling mill having a pair of opposed work rolls, a pair of back-up rolls for respectively supporting said work rolls vertically and driving said work rolls, a plurality of horizontal support rollers contacting said work rolls at respective barrel circumference locations outside a predetermined rolling region and at both horizontal sides of the work rolls and acting to fix a position of the work rolls in both horizontal directions during rolling and to oppose horizontal rolling forces, respective counterbending members for applying horizontal counterbending forces to said two work rolls by contacting the work rolls at respective barrel circumference locations axially further from the rolling region than said support rollers and actuators for urging said counterbending members against said work rolls, said counterbending forces being in a same horizontal direction as a net horizontal force applied to the work roll by the respective back-up roll and the material being rolled, and control means arranged for applying counterbending forces to a respective one of said work rolls independently of the counterbending forces applied to the other said work roll, so that for each work roll the counterbending forces applied are in a horizontal direction in a same direction as said net horizontal force with offsetting forces applied by the support rollers and the counterbending members serving to minimize horizontal bending of the work rolls during rolling operations to thereby increase effective rigidity of the work rolls.

20. A method of control of a rolling mill in which a work roll is supported vertically and driven by a back-up roll and is positioned horizontally and supported horizontally by support rollers contacting the work roll at barrel circumference locations outside a predetermined rolling region, said method comprising during rolling applying counterbending forces to the work roll at barrel circumference locations axially outside the support rollers in dependence on at least one of quantities (a) horizontal deflection of the work roll and (b) horizontal force acting on the work roll, said counterbending forces acting in a same direction as net horizontal force applied to the work roll by the backup roll and rolled material with offsetting forces applied by the Support rollers and the counterbending forces serving to minimize horizontal bending of the work rolls during rolling operations to thereby increase effective riqidity of the work rolls.

21. A method according to claim 20, wherein said counterbending force is applied by means of counterbending rollers contacting said work rolls at their respective barrel circumference and actuator means acting to move said counterbending rollers relative to said support rollers.

22. A method according to claim 20 further including shifting said work roll horizontally to a predetermined position for rolling by moving said support rollers.

23. A method of operation of a rolling mill in which a work roll is supported vertically and driven by a back-up roll, comprising locating said work roll horizontally and supporting it against horizontal rolling forces by means of support rollers contacting said work roll at barrel circumference locations outside a predetermined rolling region and applying horizontal counterbending forces tending to reduce horizontal bending of said work roll by means of counterbending rollers contacting said work roll at barrel circumference locations axially further from said rolling region than said support rollers, said counterbending rollers being movable in a horizontal direction relative to said support rollers with offsetting forces applied by the support rollers and the counterbending rollers serving to minimize horizontal bending of the work rolls during rolling operations to thereby increase effective rigidity of the work rolls.

24. A method of control of a rolling mill in which two opposed work rolls are supported vertically and driven by respective back-up rolls, comprising during rolling controlling horizontal bending of said two work rolls by applying roll-bending forces in a horizontal direction opposing a direction of horizontal rolling forces to respective work roll locations outside a predetermined rolling region and applying counterbending forces in a same horizontal direction as the direction of horizontal rolling forces to respective work roll locations axially further from the rolling region than said roll-bending forces with offsetting forces applied by the roll-bending forces and the counterbending forces serving to minimize horizontal bending of the work rolls, and wherein the roll-bending forces and the counterbending forces are applied independently in dependence on at least one sensed condition of each work roll.

25. A method according to claim 24, wherein said horizontal roll-bending forces are applied to said work roll by rollers contacting said work roll at its barrel circumference outside the rolling region.

26. A method of manufacturing metal strip comprising:

rolling metal material in a rolling mill in which a work roll is supported vertically and driven by a back-up roll and is positioned horizontally and supported horizontally by support rollers contacting the work roll at barrel circumference locations outside a predetermined rolling region, said method comprising during rolling applying counterbending forces to the work roll at barrel circumference locations axially further from said rolling region than said support rollers in dependence on at least one of horizontal deflection of the work roll and horizontal force acting on the work roll, said counterbending forces acting in a same direction as a net horizontal force applied to the work roll by the back-up roll and the metal material with offsetting forces applied by the support rollers and the counterbending forces serving to minimize horizontal bending of the work rolls during rolling operations to thereby increase effective rigidity of the work rolls.

27. A method according to claim 26, wherein said applying of counterbending forces includes moving counterbending rollers contacting said work rolls at their respective barrel circumference with movement of the counterbending rollers relative to said support rollers.

28. A method according to claim 27, further including shifting said work roll horizontally to a predetermined position for rolling by moving said support rollers.

29. A method according to claim 26, wherein said applying of counterbending forces includes applying counterbending forces to the work roll at locations axially outside of the locations of the respective support rolls.

* * * * *